US010112818B1

(12) United States Patent
Murray

(10) Patent No.: US 10,112,818 B1
(45) Date of Patent: Oct. 30, 2018

(54) LIQUID DISPENSING TAP AND CLOSURE ASSEMBLY THEREFOR

(71) Applicant: Scholle IPN Corporation, Northlake, IL (US)

(72) Inventor: Chris Murray, Chicago, IL (US)

(73) Assignee: Scholle IPN Corporation, Northlake, IL (US)

( * ) Notice: Subject to any disclaimer, the term of this patent is extended or adjusted under 35 U.S.C. 154(b) by 0 days.

(21) Appl. No.: 15/615,891

(22) Filed: Jun. 7, 2017

(51) Int. Cl.

| | |
|---|---|
| ***B22D 37/00*** | (2006.01) |
| ***B22D 41/00*** | (2006.01) |
| ***B67D 3/00*** | (2006.01) |
| ***B67D 7/06*** | (2010.01) |
| ***C21B 7/12*** | (2006.01) |
| ***B67D 1/00*** | (2006.01) |
| ***B65D 47/08*** | (2006.01) |
| ***B65D 47/30*** | (2006.01) |
| ***B67D 7/00*** | (2010.01) |

(52) U.S. Cl.
CPC ..... *B67D 1/0042* (2013.01); *B65D 47/0857* (2013.01); *B65D 47/305* (2013.01); *B67D 7/005* (2013.01)

(58) Field of Classification Search
CPC ..... B67D 1/0042; B67D 7/005; B67D 3/043; B65D 47/0857; B65D 47/305; B65D 47/20
USPC ..... 222/509
See application file for complete search history.

(56) References Cited

U.S. PATENT DOCUMENTS

| | | | | |
|---|---|---|---|---|
| 4,640,493 | A * | 2/1987 | Dudzik | F16K 21/04 222/153.06 |
| 5,337,775 | A * | 8/1994 | Lane | B65D 77/067 137/318 |
| 6,296,157 | B1 * | 10/2001 | Erb | B67D 3/043 222/509 |
| 6,409,406 | B1 * | 6/2002 | Schwartzman | B43M 11/06 222/209 |
| 2004/0256423 | A1 * | 12/2004 | Roser | B67D 3/043 222/518 |

* cited by examiner

*Primary Examiner* — Benjamin R Shaw
(74) *Attorney, Agent, or Firm* — The Watson IP Group, PLC; Jovan N. Jovanovic; Vladan M. Vasiljevic

(57) ABSTRACT

A liquid dispensing tap having a body and a closure assembly. The closure assembly having a stirrup, a closure member and a spring assembly attached to each of the stirrup and the closure member. The spring assembly having a first spring and a second spring on opposing sides of the closure member, the springs having a first end and a second end and a curved region therebetween, the first ends of the spring members being oblique to the closure axis of the closure member and the second ends of the spring members being oblique to the stirrup plane of the stirrup plane.

15 Claims, 8 Drawing Sheets

LIQUID DISPENSING TAP AND CLOSURE ASSEMBLY THEREFOR

CROSS-REFERENCE TO RELATED APPLICATION

N/A

BACKGROUND OF THE DISCLOSURE

1. Field of the Disclosure

The disclosure relates in general to liquid dispensing taps, and more particularly, to a liquid dispensing tap that is well suited for bag in box applications, wherein the tap utilized for the dispensing of flowable material from within the bag of the bag in box package. Of course, the tap is not limited thereto, and, the tap may have other applications, without limitation, wherein the bag in box application is merely exemplary and not limiting.

2. Background Art

The use of liquid dispensing taps is well known in the art. Additionally, the use of bag in box packaging is well known in the art. A number of different closures and dispensing taps are well known for the dispensing of flowable material from a bag in box application. Some of such taps are disclosed in U.S. Pat. Nos. 6,360,925 and 6,569,157 both of which are issued to Rene Erb, and assigned to Scholle Corporation. One particular configuration of such a tap is disclosed in the embodiment of FIGS. 8 through 10 of the foregoing patents. Both of the patents are incorporated in their entirety in the present application.

Such liquid dispensing taps, and in particular, the liquid dispensing tap of the embodiment of FIGS. 8 through 10 have been quite successful and have been in commercial use for a number of years. However, it has been noted that improvements to the operation of such liquid dispensing taps can nevertheless be improved. Amongst other areas of improvement, it would be advantageous to improve the performance of the spring, while having the constraints of the outer body and the closure assembly.

SUMMARY OF THE DISCLOSURE

The disclosure is directed, in some aspects, to a liquid dispensing tap comprising a body and a closure assembly. The body has an inner cavity with an inlet and an outlet and an actuator assembly. The inlet is configured to be attached to a spout in fluid tight engagement. The outlet is spaced apart from the inlet and an actuator assembly having a user actuatable control button. The manipulating rod extends into the inner cavity. The closure assembly is positionable within the inner cavity of the body. The closure assembly includes a stirrup, a closure member and a spring assembly. The stirrup is attached to the body in fixed engagement. The stirrup defines a stirrup plane. The stirrup includes a first spring mounting brace on a first side of the stirrup, and a second spring mounting brace on a second side of the stirrup. The first spring mounting brace and the second spring mounting brace are oblique to the stirrup plane and extending from a top surface of the stirrup. The closure member has an actuator engagement structure and a plug member. The actuator engagement structure is slidably engageable with the manipulating rod. The plug member is structurally configured to be engageable with the outlet in sealed engagement. The closure member is movable along a closure axis. The closure axis is substantially perpendicular to the stirrup plane. The spring assembly biases the closure member into sealed engagement with the outlet, and includes a first spring and a second spring. The first spring has a first end extending from a first side of the closure member and a second end extending from the first spring mounting brace. The first spring member has an inner leg region and an outer leg region substantially parallel to the inner leg region, with a central curved region therebetween. The inner region is substantially perpendicular to the first spring mounting brace. The second spring has a first end extending from a second side of the closure member and a second end extending from the second spring mounting brace. The second spring member has an inner leg region and an outer leg region substantially parallel to the inner leg region, with a central curved region therebetween. The inner region is substantially perpendicular to the second spring mounting brace.

In some configurations, the first spring and the second spring are mirror images of each other about the closure axis.

In some configurations, the central curved region of each of the first spring and the second spring comprises a semi-circle.

In some configurations, the stirrup further includes a closure member transverse recess through which the closure member traverses.

In some configurations, the stirrup further includes a central portion between the first spring mounting brace and the second spring mounting brace. The central portion further includes a rod receiving channel having opposing side walls and a base wall. The manipulating rod is extendable into the rod receiving channel so as to slidably engage the base wall.

In some configurations, the actuator engagement structure further includes a lower surface, an upper surface and opposing side surfaces to define an opening. Slidable movement of the manipulating rod engages the upper surface and directs the closure member in an upward direction relative to the stirrup, to controllably move the plug member away from sealed engagement with the outlet.

In some configurations, the first end of the first spring extends from the lower surface of the actuator engagement structure. Additionally, the first end of the second spring extends from the lower surface of the actuator engagement structure.

In some configurations, the inner leg region of the first spring is oblique to the lower surface of the actuator engagement structure. The inner leg region of the second spring is oblique to the lower surface of the actuator engagement structure.

In another aspect of the disclosure, the disclosure is directed to a liquid dispensing tap including a body and a closure assembly. The body has an inner cavity with an inlet, an outlet and an actuator assembly. The inlet is configured to be attached to a spout in fluid tight engagement. The outlet is spaced apart from the inlet and an actuator assembly having a user actuatable control button. The manipulating rod extends into the inner cavity. The closure assembly is positionable within the inner cavity of the body. The closure assembly further comprises a stirrup, a closure member and a spring assembly. The stirrup is attached to the body in fixed engagement. The stirrup defining a stirrup plane with a top surface and a bottom surface. The closure member has an actuator engagement structure and a plug member. The actuator engagement structure is engageable by the manipulating rod. The plug member is structurally configured to be engageable with the outlet in sealed engagement. The closure member is movable along a closure axis which is substantially perpendicular to the stirrup plane. The spring assembly biases the closure member into sealed engagement with the outlet and comprises a first spring and a second spring. The first spring is on a first side of the closure axis and has a first end coupled to the closure member and a second end coupled to the stirrup with a curved region therebetween. The second spring is on a second side of the closure axis opposite the first side and has a first end coupled to the closure member and a second end coupled to the stirrup. The first end of each of the first spring and the second spring couple to the closure member oblique to the closure axis. The second end of each of the first spring and second spring couple to the stirrup oblique to the stirrup plane.

In some configurations, the first spring and the second spring are mirror images of each other about the closure axis.

In some configurations, the first spring further includes an inner leg region extending from the first end and an outer leg extending from the second end, with the curved region positioned therebetween. The inner leg and the outer leg is substantially parallel to each other.

In some configurations, the stirrup further includes a first spring mounting brace and a second spring mounting brace. The first spring mounting brace has an oblique connecting wall that is oblique to the stirrup plane. The second mounting brace has an oblique connecting wall that is oblique to the stirrup plane. The second end of the first spring is attached to the first spring mounting brace and the second spring is attached to the second spring mounting brace.

In some configurations, the outer leg of the first spring is perpendicular to the oblique connecting wall of the first spring mounting brace. The outer leg of the second spring is perpendicular to the oblique connecting wall of the second spring mounting brace.

In some configurations, the second end of the first spring and the second end of the second spring are spaced apart from each other a distance that is substantially equal to a width of the plug member.

In some configurations, the stirrup further includes a closure member transverse recess, with the closure member positioned therein, and translatable therethrough.

BRIEF DESCRIPTION OF THE DRAWINGS

The disclosure will now be described with reference to the drawings wherein.

DETAILED DESCRIPTION OF THE DISCLOSURE

Figure 1:
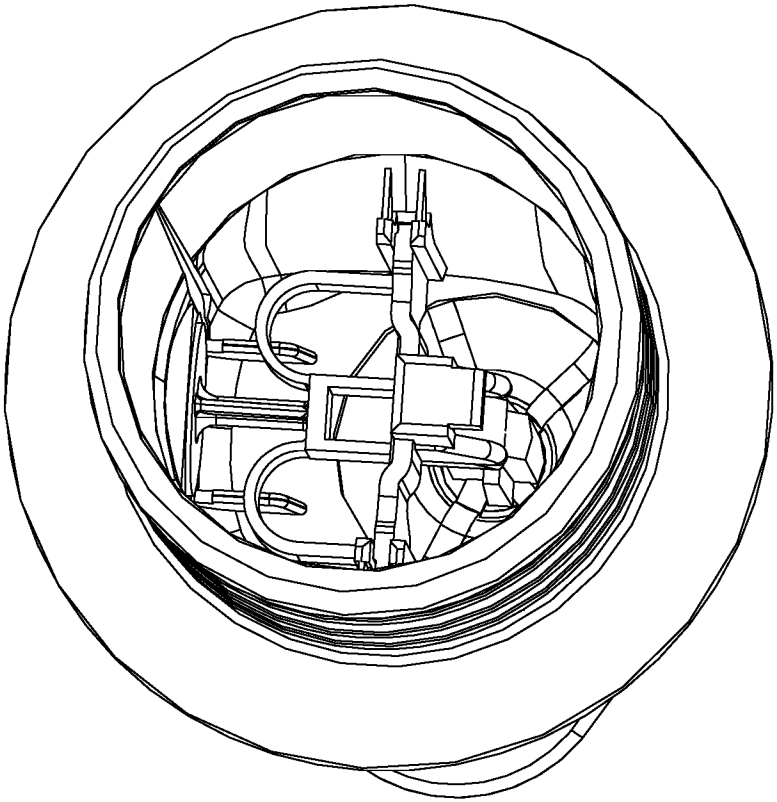
PRIOR ART FIGURE 1
FIG. 1 of the drawings is a back perspective view of a liquid dispensing tap of the prior art in accordance with the disclosure of the '157 and '925 patents.

While this disclosure is susceptible of embodiment in many different forms, there is shown in the drawings and described herein in detail a specific embodiment(s) with the understanding that the present disclosure is to be considered as an exemplification and is not intended to be limited to the embodiment(s) illustrated.

It will be understood that like or analogous elements and/or components, referred to herein, may be identified throughout the drawings by like reference characters. In addition, it will be understood that the drawings are merely schematic representations of the invention, and some of the components may have been distorted from actual scale for purposes of pictorial clarity.

Referring now to the drawings and in particular to FIG. 1, the liquid dispensing tap is shown generally at 10. It will be understood that the liquid dispensing tap is configured to dispense a flowable material, such as, for example, a liquid such as wine, or another beverage, a syrup, a puree or the like. It will further be understood that the outlet shape and size can be modified, for example, depending on the flowable material that is to be dispensed. It will further be understood that while the disclosure references the tap as a liquid dispensing tap, the term liquid is descriptive and not limiting as to the different flowable materials contemplated for dispensing by the tap.

The liquid dispensing tap 10 includes body 12 and closure member 14. It will be understood that the tap is attachable to a spout of a bag, typically a flexible bag that is configured for use in association with bag in box packaging. One common type of such packaging is in the field of wind packaging. And, such a tap is well suited for the dispensing of wine. It will be understood that the outer body shape and configuration is quite similar to that which is disclosed in the '925 and '157 patents identified in the background of the disclosure, and which have been incorporated by references. The improvement herein is the operation and the structure of the closure assembly and the reliability, longevity and durability of the same.

Figure 2:
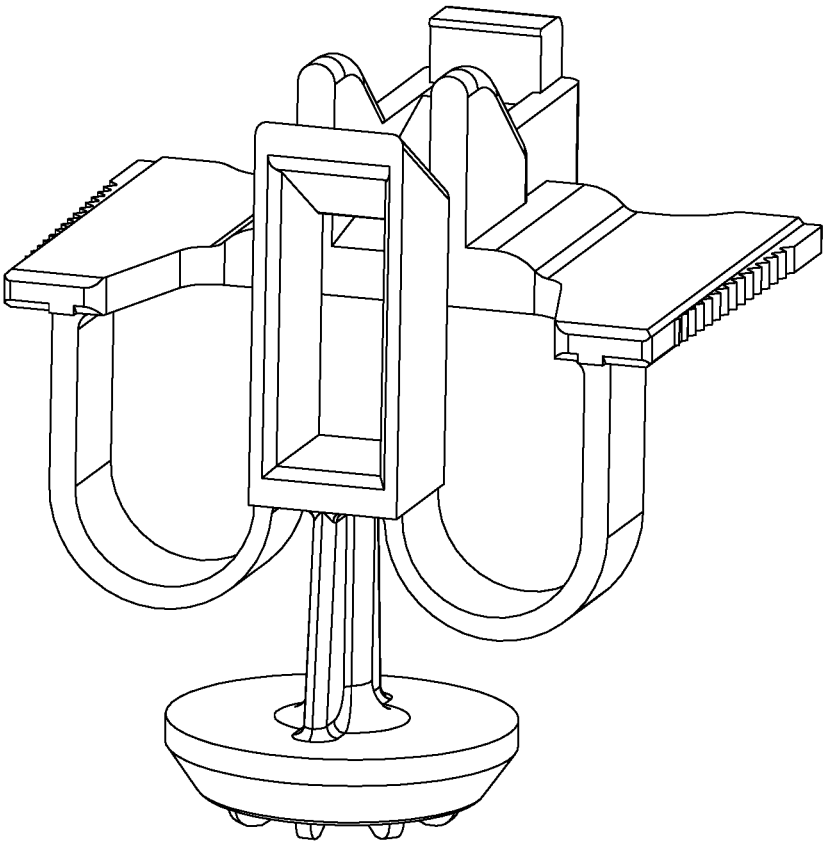
PRIOR ART FIGURE 2
FIG. 2 of the drawings is a perspective view of the closure member of the liquid dispensing tap of the prior art in accordance with the disclosure of the '157 and '925 patents.

More specifically, the body 12 of the liquid dispensing tap 10 is shown in FIG. 2 as comprising dispensing portion 20, spout coupling portion 22 and actuator assembly 30. The dispensing portion 20 includes outlet 26 and the spout coupling portion 22 includes an inlet 28. The structures are generally separated by a flange. It will be understood that the spout coupling portion 22 is configured to engage an inner wall of a spout and to be sealed in substantially fluid tight and desirably a fully fluid tight engagement. Ribs or other surface configurations may be present to insure the fluid tight sealing engagement. It will be understood that the size of the spout coupling portion, and in turn the inlet 28 can be varied depending on the application.

The outlet 26 is shown as being at a 90° angle relative to the inlet and generally smaller than the inlet (although, again, variations are contemplated). In other configurations, the outlet and inlet may have different relative positions, and may be angled relative to each other at different angles. In the present configuration, it is contemplated that the tap is coupled to the spout about a sidewall of a box of a bag in box packaging. As such, the inlet is substantially horizontal. It is desired that the outlet direct fluid in a downward direction, and, with the present configuration, the outlet is in a generally downward direction.

The inlet and outlet cooperate to provide ingress into and egress out of the body 12, and more particularly, the inner cavity 29. The shape of the inner cavity can be varied depending on the flowable material dispensed. In the present configuration, the body includes structures which aid in the retention by the user, and which aid in directing the user to the membrane (control button) of the actuator. Opposing rails 24*a*, 24*b* are present on opposing sides of the tap, each along the inner cavity. These rails are configured to engage the rim engaging portions 63, 263 of the stirrup 40, as will be explained below. In the configuration shown, the rails are generally perpendicular to an axis defined by the opening, and generally parallel to an axis defined by the outlet and the control button of the actuator assembly 30. Of course, variations are contemplated.

The actuator assembly 30 includes membrane 32 (i.e., the control button) and manipulating rod 34. In the configuration shown, the membrane 32 is co-molded with the manipulating rod and the body 12. To provide structure and joining of the manipulating rod 34, a plurality of flexible bridges extend from the body to the manipulating rod. In other configurations, the manipulating rod can be a separate element, or can be molded together with the control button which also may be a separate member. It is contemplated that the control button may be glued or otherwise sealingly attached to the body 12 in a fluid tight configuration.

The manipulating rod 34 has a first end 36 at the control button 32 and a second end 38 distally spaced apart therefrom. The second end includes upper surface 37 and lower surface 39. The upper surface 37 slidably engages the upper surface 84 of the actuator engagement structure of the closure member 42. The lower surface slidably engages the base wall 56 of the rod receiving channel 52 of the stirrup of the closure assembly 14. It will be understood that by shaping the upper and lower surfaces, different characteristics of the movement of the closure member along the closure axis 170 can be realized. In the configuration shown, the upper surface has an initial region, followed by an inclined region, wherein engagement with the actuator engagement structure occurs predominantly at the inclined region.

Figure 3:
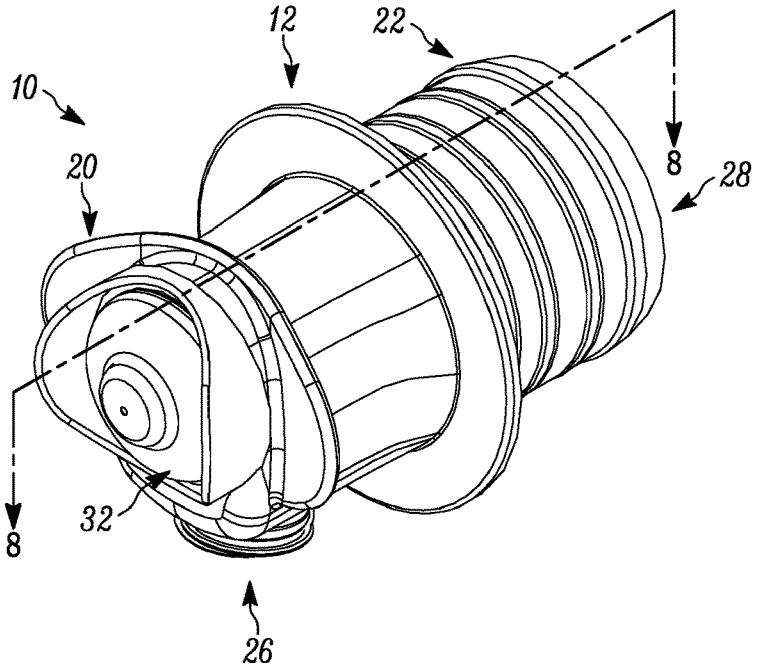
FIG. 3 of the drawings is a front, top perspective view of the liquid dispensing tap of the present disclosure.
Figure 4:
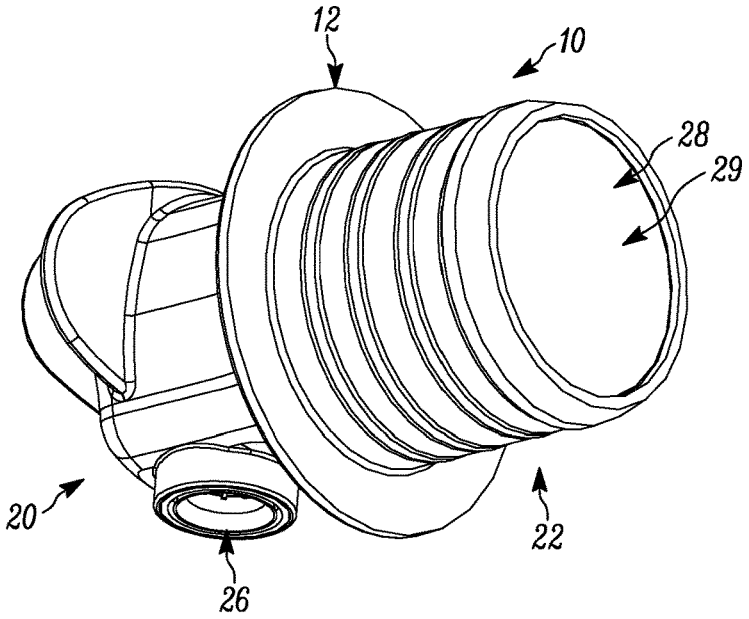
FIG. 4 of the drawings is a back, bottom perspective view of the liquid dispensing tap of the present disclosure.
Figure 5:
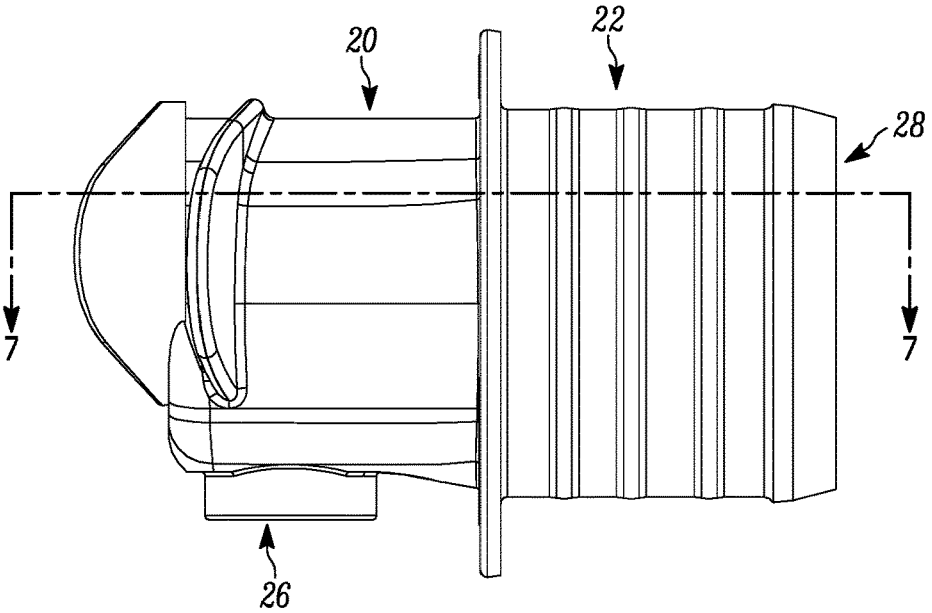
FIG. 5 of the drawings is a side elevational view of the liquid dispensing tap of the present disclosure.
Figure 6:
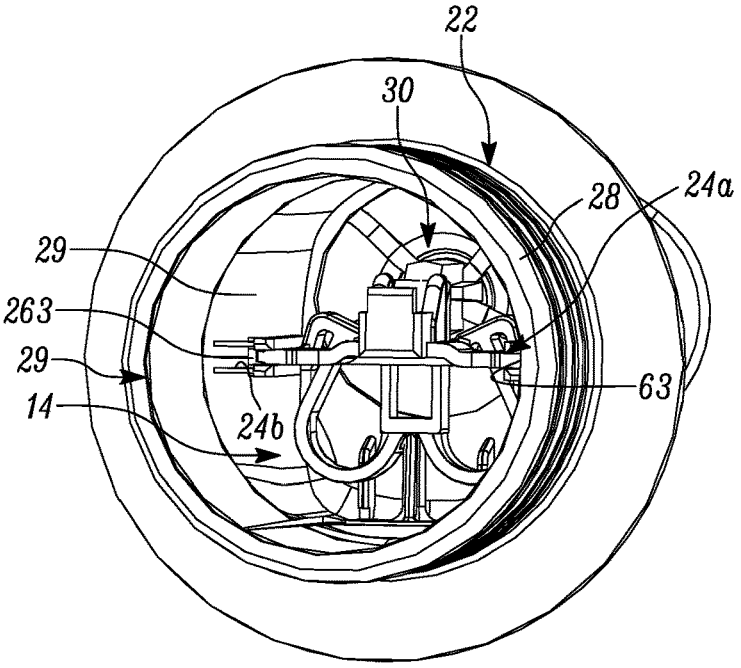
FIG. 6 of the drawings is a back perspective view of the liquid dispensing tap of the present disclosure, showing, in particular, the inlet as well as the closure assembly.
Figure 7:
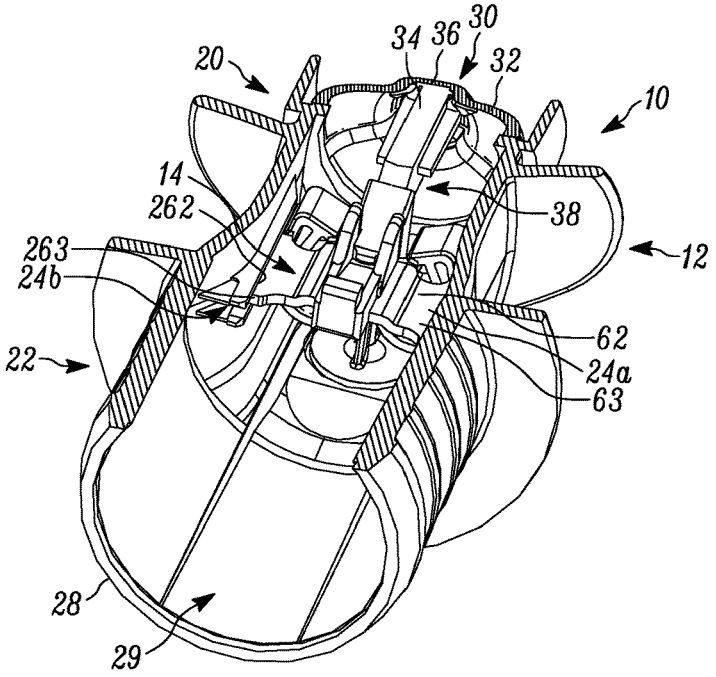
FIG. 7 of the drawings is a cross-sectional view of the liquid dispensing tap of the present disclosure, taken generally about lines 7-7 of FIG. 5.
Figure 8:
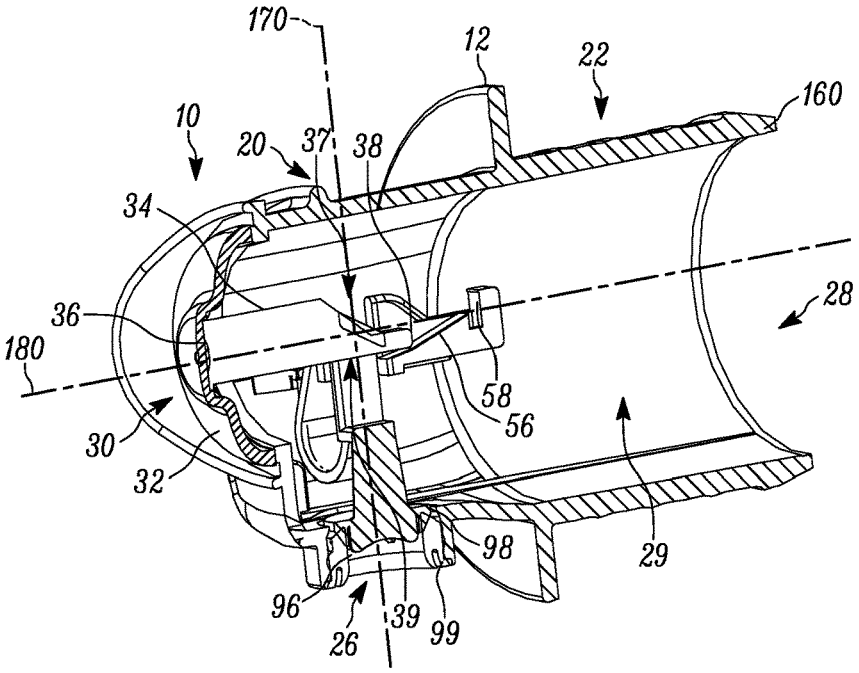
FIG. 8 of the drawings is a cross-sectional view of the liquid dispensing tap of the present disclosure, taken generally about lines 8-8 of FIG. 3.
Figure 9:
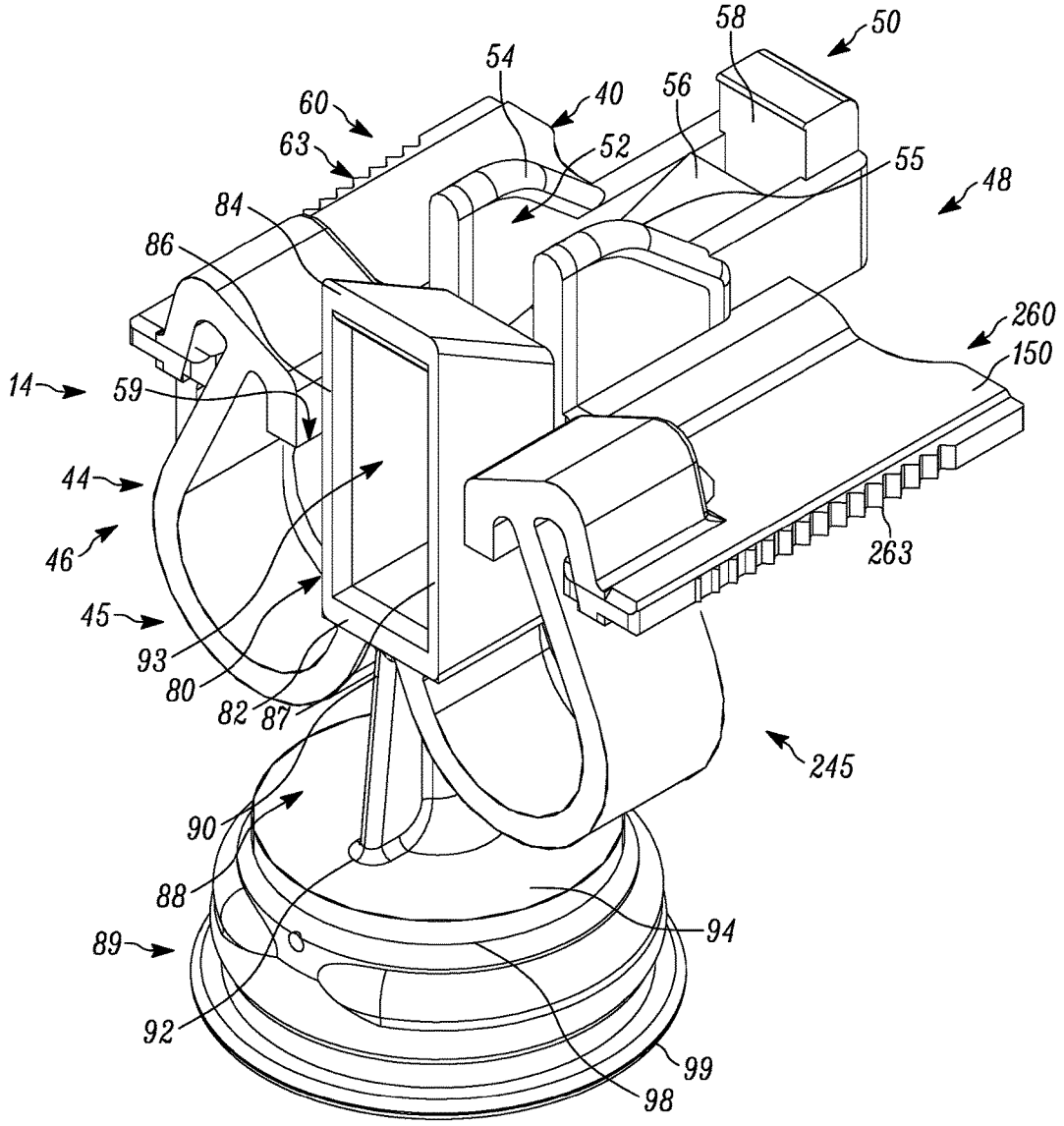
FIG. 9 of the drawing is a front perspective view of the closure assembly of the liquid dispensing tap of the present disclosure.
Figure 10:
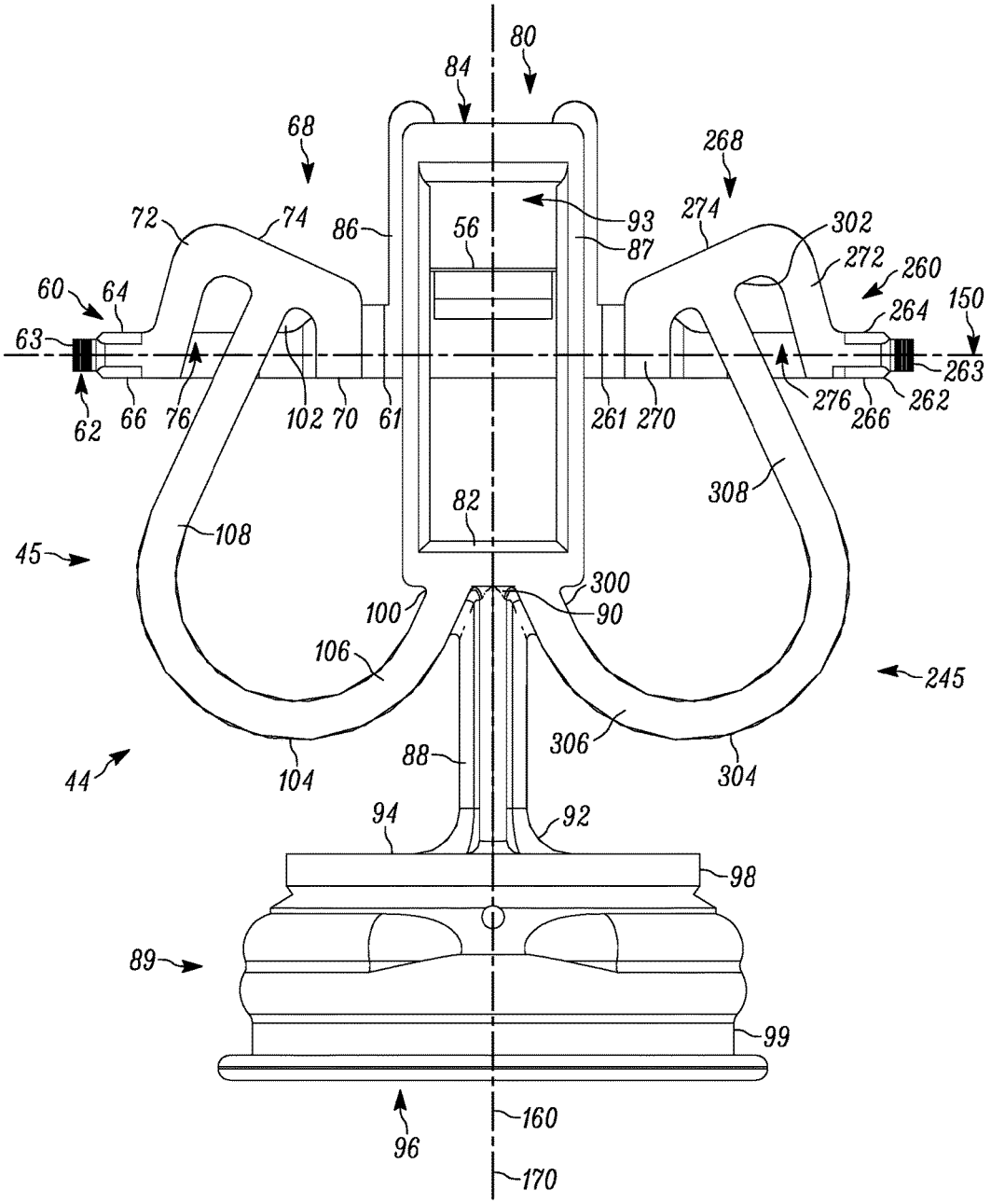
FIG. 10 of the drawings is a front elevational view of the closure assembly of the liquid dispensing tap of the present disclosure.
Figure 11:
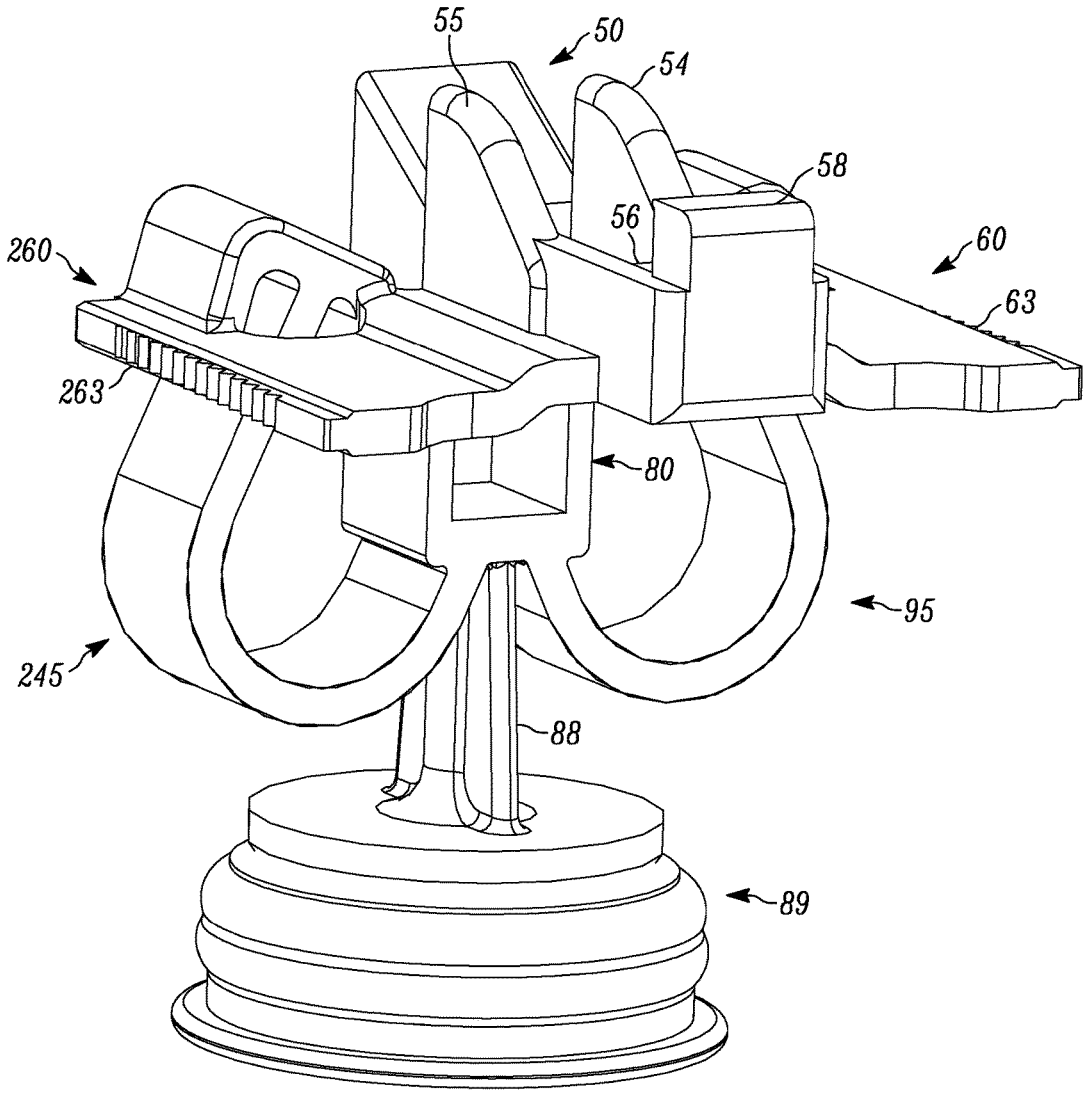
FIG. 11 of the drawings is a back perspective view of the closure assembly of the liquid dispensing tap of the present disclosure.

The closure assembly 14 is shown in FIG. 3 as comprising stirrup 40, closure member 42 and spring assembly 44. As set forth above, the closure assembly 14 is positioned within the inner cavity 29 of the body 12. It is contemplated that in the unstressed state, the plug member is biased into closure with the outlet 26 of the body 12 in sealing engagement.

The stirrup 40 includes forward end 46 and rearward end 48. The forward end is positioned proximate the front of the body with the rearward end positioned toward the rear of the body, while the stirrup is preferably mounted within the dispensing portion of the body (although not required to be positioned thereat). The stirrup includes central portion 50, first opposing wing 60 and second opposing wing 260. The wings generally define a stirrup plane 150 that is generally perpendicular to the closure axis 170, and to the closure plane 160. Of course, other variations are contemplated, for example, and without limitation, when the outlet is oblique to the downward direction of an installed spout as part of a bag in box packaging.

The central portion 50 includes rod directing channel 52 and closure member transverse recess 59. The rod directing channel 52 is generally centrally located and defines a channel that is perpendicular to the stirrup plane. The rod directing channel includes side walls 54, 55, base wall 56 and stop 58. The side walls 54, 55 are on opposite sides of each other and spaced apart so as to allow the manipulating rod to slidably pass along the base wall without impingement (while directing the manipulating rod, should the rod be directed off course). The base wall is inclined in an upward direction from the forward end to the rearward end thereof. It will be understood that the configuration of the base wall alters the movement of the manipulating rod and the relative displacement of the closure member thereby. In the configuration shown, the stop 58 extends across between the sidewalls and limits further inward movement of the manipulating rod should the second end reach the stop 58. The stop is generally perpendicular to the side walls and to the stirrup plane, with the side walls being parallel to each other. In the configuration shown, the closure assembly is generally a mirror image about a closure axis 170 that bisects the rod receiving channel and is perpendicular to the stirrup plane.

The closure member transverse recess 59 is defined by the region forward of the rod receiving channel and inboard of the first and second opposing wings 60, 260, and is configured to allow the closure member to traverse along the closure axis in the transverse direction. The recess is wider than the actuator engagement structure so as to minimize impingement or contact therebetween.

The first opposing wing 60 is shown in FIG. 2 as comprising inner end 61, outer end 62, top surface 63, bottom surface 66 and spring mounting brace 68. The first opposing wing 60 extends outwardly from the central portion with the inner end defining the inboard side, and the outer end defining the outboard side. The first opposing wing may include thicker regions as well as offset portions, for example, where the wings meet the central portion.

A rim engaging portion 63 is disposed at the outer end 62. In the configuration shown, the rim engaging portion 63 comprises a member that is outwardly inclined between the forward end and the rearward end of the stirrup and which includes gripping teeth to engage the retaining rails. It will be understood that the inclined configuration further directs an outward force against the body to further aid in the maintaining of the closure assembly in the desired engaged position relative to the body 12.

The spring mounting brace 68 includes inner wall 70, outer wall 72 and oblique connecting wall 74. The mounting brace is positioned at the forward end 46 of the stirrup. The inner wall 70 extends from the inner end 61 in a direction above the top surface 64. In the configuration shown, the inner wall 70 is substantially perpendicular to the stirrup plane 150. The outer wall 72 extends oblique to the stirrup plane and in a direction above the top surface 64. The length of the outer wall 72 is greater than that of the inner wall 70, with the two walls being oblique to each other. The oblique connecting wall 74 spans between the inner wall and the outer wall, and is oblique to the inner wall, and oblique to the outer wall (while variations to each are contemplated, some of which may be perpendicular). The inner wall and the outer wall are also oblique to each other, with corresponding extended planes of each intersecting above the spring mounting brace. The oblique connecting wall 74 is oblique to the stirrup plane and inclined in an upward direction from the inner end to the outer end of the first opposing wing 60 so that the outer end of the oblique wall is further from the top surface than the inner end of the oblique wall. It will be understood that the width of the spring mounting brace is such that it generally matches the closure member transverse recess 59.

The inner wall, outer wall and oblique connecting wall together define the mounting recess channel 76. In the configuration shown, the mounting recess channel extends into a portion of the first opposing wing to create a hemispherical void immediately rearward of the spring mounting brace. In the configuration shown, the entirety of the spring mounting brace is above the top surface 64 of the opposing wing, while variations are contemplated wherein portions of the brace are below the opposing wing, or include components that are below the opposing wing. It is contemplated that the oblique connecting wall 74 is at least partially above the top surface of the first opposing wing so as to provide additional length to the springs of the spring assembly 44.

The second opposing wing 260 is a mirror image of the first opposing wing 60. As such, the structures of the second opposing wing 260 will have the same reference numbers as the first opposing wing, augmented by 200. While the structures are identical, it is contemplated that the structures may be different and that the two structures, while having similar functions, may have different configurations, so as to provide the same or different performance. In the configuration shown, the two sides cooperate with the respective springs of the spring assembly to collectively move the closure member in a uniform manner. It is contemplated that a non-uniform movement pattern is likewise contemplated.

In the configuration shown, the stirrup, the spring assembly and the closure member (absent the gasket 99) are integrally formed, through, for example, injection molding. It is contemplated that the gasket may be co-molded therewith, or a different geometry can be selected in which case the gasket is not required or necessary to achieve sealed closure of the outlet.

The closure member 42 is shown as comprising actuator engagement structure 80, neck 88 and plug member 89. As set forth above, the closure member is integrally molded with the stirrup and the spring assembly. The closure member 42 generally defines a closure axis, which is transverse (or perpendicular) to the stirrup plane 150. The closure axis generally is centered on the outlet and is generally transverse thereto as well.

The actuator engagement structure 80 includes lower surface 82, upper surface 84 and side surfaces 86, 87. The surfaces cooperatively generally define an rectangular opening 93. In the configuration shown, the side surfaces 86, 87 are generally parallel to each other and offset, with the lower surface being perpendicular thereto. The side surfaces are also generally parallel to the closure axis. The upper surface 84 is inclined in a downward direction between the forward end and the rearward end thereof. In the configuration shown, the angle of inclination of the inclined upper surface substantially matches the inclination of the inclined portion of the upper surface of the second end of the manipulating rod 34. While inclined, the upper surface 84 is substantially perpendicular to the side surfaces 86, 87. It will be understood that other structures of the actuator engagement structure are contemplated, so long as such structures interface with the manipulating rod, and facilitate the movement of the closure member in response to the manipulating rod, and within the limits directed by the spring assembly, among other considerations.

The neck 88 includes an upper end 90 and a lower end 92. The neck spans between the actuator engagement structure 80 at the upper end and the plug member 89 at the lower end. The plug member 89 includes back surface 94, outer surface 96 and outer rim 98. The back surface 94 meets the lower end of the neck 88. The outer surface 96 may include surface variations that limit the formation of drips after the closure member has sealed the outlet. The outer rim 98 is configured to substantially match the structure of the outlet 26 and the gasket 99 can extend about the outer rim 98 to provide a sealing closure with the outlet 26. In other configurations, it is contemplated that the gasket may be eliminated or may be co molded with the closure member, or a separate member as shown herein. It is further contemplated that the shape of the actuator, neck and plug member can be altered while maintaining the function thereof. For example, the actuator may extend to the plug member, eliminating a neck, or altering the shape of the neck. Alternatively, a differently configured actuator engagement structure may require a differently configured neck to span between the actuator engagement structure and the neck.

In the configuration shown, the neck comprises a planar member that generally is coplanar with the closure axis 170 and the closure plane 160. The neck member is generally centered about the back surface 94 of the plug member, which comprises a substantially circular member, matching the circular configuration of the outlet. The neck is slightly wider at the lower end and slightly narrower at the upper end, wherein at the upper end, the width matches that of the actuator engagement structure and the width of the spring member (as well as the respective spring mounting braces). It will be understood that the closure member is substantially centered relative to the stirrup and a mirror image about a the closure plane 160 so as to define a first side and a second side of the closure member corresponding to the sides associated with the first opposing wing and the second opposing wing.

Spring assembly 44 is shown in FIG. 3 as comprising first spring 45 and second spring 245. It will be understood that the second spring, in the configuration shown, is a mirror image of the first spring as taken about the closure plane. In such a configuration, the first spring will be explained with the understanding of the relationship between the first spring and the second spring. Structures on the second spring that correspond to those of the first spring will have the same reference numbers augmented by 200.

The first spring 45 is shown as extending between first end 100 and second end 102. In particular, the first end 100 extends from the first side of the closure member with the second end 102 extending from the oblique connecting wall 74 of the spring mounting brace 68. The first spring 45 includes central curved region 104, inner leg region 106 and outer leg region 108 opposite the inner leg region. In the configuration shown, the inner leg region is substantially perpendicular to the oblique connecting wall 74 of the first spring mounting brace 68. The inner leg 106 and the outer leg 108 are substantially parallel to each other, with the central curved region being substantially semi-circular. As such, the first end 100 meets the oblique connecting wall in a generally perpendicular orientation, and generally midway between the inner wall 70 and the outer wall 72 thereof. The spring is also generally oriented so as generally remain spaced apart from the inner and outer walls throughout the operative range.

As such, the first spring opens inwardly and upwardly, and, has an oblique configuration relative to each of the closure axis and the stirrup plane. In the configuration shown, the first end of the spring intersects with the upper end of the neck 88. The first spring likewise has a width that matches that of the oblique connecting wall 74 and the width is in the direction from the forward end and the rearward end so that a plane through the width at any location is generally parallel with the upper surface 84 of the actuator engagement structure 80. Additionally, in the configuration shown, the distance between the first end of the first spring 45 and the first end of the second spring 245 is substantially equal to the diameter of the outer rim 98 of the plug member 89. Additionally, in the configuration shown, a spring plane defined by the center of the central curved region that is parallel to the inner leg region and the outer leg region intersects the upper surface 84 of the actuator engagement structure proximate the closure axis bisecting the same. In the configuration shown and described, the spring plane is inclined relative to the closure axis is preferably between 10 and 80 degrees, and preferably between 20 and 40 degrees. Of course, variations are likewise contemplated.

In operation, the liquid dispensing tap 10 can be mounted to, or coupled to, a spout of a bag that can be positioned in a box to form a bag in box container. Typically, for dispensing, such a tap is positioned so as to be spatially fixed to a wall of the container (such as, a substantially vertically mounted side of the box). In such an orientation, the tap is generally positioned so that the stirrup plane is substantially horizontal and the closure axis is substantially vertical. It will be understood that the tap is coupled to the spout so that flowable material has entered through the inlet 28 and is within the inner cavity 29. The closure member 42 is pressed against the outlet 26 so as to preclude the passage of flowable material through the outlet 26.

When the user is ready to dispense flowable material from within the liquid dispensing tap, the user depresses the control button. As the control button is pressed, the manipulating rod moves inwardly, toward the back of the tap. Initially, the manipulating rod is positioned so that the lower surface 39 is resting on the base wall 56 of the rod receiving channel and the upper surface generally abuts a portion of the upper surface 84 of the actuator engagement structure.

As the manipulating rod moves toward the back of the tap, the upper surface 37 of the manipulating rod interfaces with the upper surface 84 of the actuator engagement structure 80 to impart an upward force on the upper surface 84 of the actuator engagement structure 80. The upward force eventually overcomes the spring assembly and directs the closure member 42 in the upward direction. Upon sufficient upward movement of the closure member, the plug member eventually is moved sufficiently away from the outlet that the flowable material can pass between the plug member and the outlet, and, in turn, outside of the outlet.

The force applied by the manipulating rod against the closure member is imparted into the spring assembly such that the spring assembly provides an opposing force in a downward direction. Thus, when the user releases the control button, the biasing force stored in the spring assembly directs the closure member back in the opposite direction (which at the same time drives the manipulating rod outwardly toward the front of the body). The spring assembly drives the closure member so that the plug member seals against the outlet 26 thereby stopping the passage of the flowable material therethrough. The spring assembly eventually reaches an equilibrium (i.e., either when the plug member is pressed against the opening) or when the spring reaches a relaxed orientation. It will be understood that the spring assembly is configured such that the spring assembly drives the closure member to seal the outlet. Preferably, the spring is preloaded in the closed configuration so that the plug member is biased against the outlet 26 when the tap is closed.

Advantageously, by having the spring configuration as disclosed, wherein the inner and outer leg regions of the springs are coupled to the closure member and to the stirrup in an orientation that is oblique to the direction of travel of the closure member, and having the central curved region, the stresses experienced by the spring through the entire operative range are reduced while providing sufficient force necessary to urge the closure member into the sealed configuration with the outlet 26. Furthermore, the spring configuration aids in the centering of the closure member as the spring is orthogonally positioned. Still further, a spring having a length greater than was previously possible improves the operation and movement of the closure member.

The foregoing description merely explains and illustrates the disclosure and the disclosure is not limited thereto except insofar as the appended claims are so limited, as those skilled in the art who have the disclosure before them will be able to make modifications without departing from the scope of the disclosure.

What is claimed is:

1. A liquid dispensing tap comprising:

a body having an inner cavity, with an inlet configured to be attached to a spout in fluid tight engagement, an outlet spaced apart from the inlet and an actuator assembly having a user actuatable control button and a manipulating rod extending into the inner cavity; and a closure assembly positionable within the inner cavity of the body, the closure assembly further comprising:

a stirrup attached to the body in fixed engagement, the stirrup defining a stirrup plane, the stirrup including a first spring mounting brace on a first side of the stirrup, and a second spring mounting brace on a second side of the stirrup, the first spring mounting brace and the second spring mounting brace being oblique to the stirrup plane and extending from a top surface of the stirrup;

a closure member having an actuator engagement structure slidably engageable with the manipulating rod, and an plug member structurally configured to be engageable with the outlet in sealed engagement, the closure member movable along a closure axis, the closure axis being substantially perpendicular to the stirrup plane; and a spring assembly biasing the closure member into sealed engagement with the outlet, comprising a first spring and a second spring, the first spring having a first end extending from a first side of the closure member and a second end extending from the first spring mounting brace, the first spring member having an inner leg region and an outer leg region substantially parallel to the inner leg region, with a central curved region therebetween, with the inner region being substantially perpendicular to the first spring mounting brace, and the second spring having a first end extending from a second side of the closure member and a second end extending from the second spring mounting brace, the second spring member having an inner leg region and an outer leg region substantially parallel to the inner leg region, with a central curved region therebetween, with the inner region being substantially perpendicular to the second spring mounting brace.

2. The liquid dispensing tap of claim 1 wherein the first spring and the second spring are mirror images of each other about the closure axis.

3. The liquid dispensing tap of claim 1 wherein the central curved region of each of the first spring and the second spring comprises a semicircle.

4. The liquid dispensing tap of claim 1 wherein the stirrup further includes a closure member transverse recess through which the closure member traverses.

5. The liquid dispensing tap of claim 1 wherein the stirrup further includes a central portion between the first spring mounting brace and the second spring mounting brace, the central portion further including a rod receiving channel having opposing side walls and a base wall, the manipulating rod extendable into the rod receiving channel so as to slidably engage the base wall.

6. The liquid dispensing tap of claim 1 wherein the actuator engagement structure further includes a lower surface, an upper surface and opposing side surfaces to define an opening, wherein slidable movement of the manipulating rod engages the upper surface and directs the closure member in an upward direction relative to the stirrup, to controllably move the plug member away from sealed engagement with the outlet.

7. The liquid dispensing tap of claim 6 wherein the first end of the first spring extends from the lower surface of the actuator engagement structure and the first end of the second spring extends from the lower surface of the actuator engagement structure.

8. The liquid dispensing tap of claim 7 wherein the inner leg region of the first spring is oblique to the lower surface of the actuator engagement structure and the inner leg region of the second spring is oblique to the lower surface of the actuator engagement structure.

9. A liquid dispensing tap comprising:

a body having an inner cavity, with an inlet configured to be attached to a spout in fluid tight engagement, an outlet spaced apart from the inlet and an actuator assembly having a user actuatable control button and a manipulating rod extending into the inner cavity; and a closure assembly positionable within the inner cavity of the body, the closure assembly further comprising:

a stirrup attached to the body in fixed engagement, the stirrup defining a stirrup plane with a top surface and a bottom surface;

a closure member having an actuator engagement structure engageable by the manipulating rod and a plug member structurally configured to be engageable with the outlet in sealed engagement, the closure member movable along a closure axis which is substantially perpendicular to the stirrup plane; and a spring assembly biasing the closure member into sealed engagement with the outlet and comprising a first spring and a second spring, the first spring being on a first side of the closure axis and having a first end coupled to the closure member and a second end coupled to the stirrup with a curved region therebetween, the second spring being on a second side of the closure axis opposite the first side having a first end coupled to the closure member and a second end coupled to the stirrup, the first end of each of the first spring and the second spring coupling to the closure member oblique to the closure axis, and the second end of each of the first spring and second spring coupling to the stirrup oblique to the stirrup plane.

10. The liquid dispensing tap of claim 9 wherein the first spring and the second spring are mirror images of each other about the closure axis.

11. The liquid dispensing tap of claim 10 wherein the first spring further includes an inner leg region extending from the first end and an outer leg extending from the second end, with the curved region positioned therebetween, the inner leg and the outer leg being substantially parallel to each other.

12. The liquid dispensing tap of claim 11 wherein the stirrup further includes a first spring mounting brace, the first spring mounting brace having an oblique connecting wall that is oblique to the stirrup plane, and, a second spring mounting brace, the second mounting brace having an oblique connecting wall that is oblique to the stirrup plane, wherein the second end of the first spring is attached to the first spring mounting brace and the second spring is attached to the second spring mounting brace.

13. The liquid dispensing tap of claim 12 wherein the outer leg of the first spring is perpendicular to the oblique connecting wall of the first spring mounting brace and wherein the outer leg of the second spring is perpendicular to the oblique connecting wall of the second spring mounting brace.

14. The liquid dispensing tap of claim 13 wherein the second end of the first spring and the second end of the second spring are spaced apart from each other a distance that is substantially equal to a width of the plug member.

15. The liquid dispensing tap of claim 14 wherein the stirrup further includes a closure member transverse recess, with the closure member positioned therein, and translatable therethrough.

* * * * *